United States Patent [19]

Bennett et al.

[11] Patent Number: 4,728,036

[45] Date of Patent: Mar. 1, 1988

[54] ATOMIZING NOZZLE ASSEMBLY

[75] Inventors: Adam J. Bennett; Charles E. Capes, both of Ottawa; John D. Hazlett; Kevin A. Jonasson, both of Orleans; William L. Thayer, Ottawa, all of Canada

[73] Assignee: National Research Council of Canada, Ottawa, Canada

[21] Appl. No.: 931,557

[22] Filed: Nov. 17, 1986

[51] Int. Cl.[4] ..... B05B 1/24

[52] U.S. Cl. ..... 239/132.1; 239/139; 239/420; 239/424; 239/433; 239/514

[58] Field of Search ..... 239/420, 423, 424, 433, 239/434.5, 514, 518, DIG. 19, 132.1, 139, 132.3

[56] References Cited

U.S. PATENT DOCUMENTS

| | | | |
|---|---|---|---|
| 1,713,259 | 5/1929 | Chandler | 239/424 |
| 2,009,932 | 7/1935 | Klotzman | 239/DIG. 19 |
| 4,544,095 | 10/1985 | Litzén | 239/424 |
| 4,592,506 | 6/1986 | Capes et al. | 239/139 |
| 4,655,395 | 4/1987 | Cioffi et al. | 239/518 |

FOREIGN PATENT DOCUMENTS

| | | | |
|---|---|---|---|
| 832197 | 4/1960 | United Kingdom | 239/420 |

OTHER PUBLICATIONS

The NRCC Burner Assembly and Related Technologies: An Update Proceedings of the Fifth International Workshop on Coal-Liquids Fuels Technology, pp. 364–378, Halifax, N. S. (Oct. 1985) K. A. Jonasson, A. Bennett, W. L. Thayer, C. E. Capes and J. D. Hazlett.

*Primary Examiner*—Andres Kashnikow
*Assistant Examiner*—Karen B. Merritt
*Attorney, Agent, or Firm*—Francis W. Lemon

[57] ABSTRACT

An atomizing nozzle assembly is provided having an outwardly diverging frustrum of a cone shaped, deflector core of wear resistant ceramic, a nozzle rim of wear resistant ceramic encircling the core and coextensive with a downstream portion thereof to form a mixing zone therewith for receiving liquid-to-be-atomized therein from an unobstructed passage and atomizing fluid directing the liquid-to-be-atomized away from the core. The mixing zone leads to a nozzle orifice outlet. The core is mounted in a core holder and is adjustable by a screw thread, in close proximity to the mixing zone, to adjust the width of the mixing zone. The liquid-to-be-atomized (e.g. a coal slurry fuel) and the atomizing fluid (e.g. air) are fed along coaxial tubes which are slidably mounted by glands to accommodate differential expansions.

2 Claims, 2 Drawing Figures

ATOMIZING NOZZLE ASSEMBLY

Figure 1:
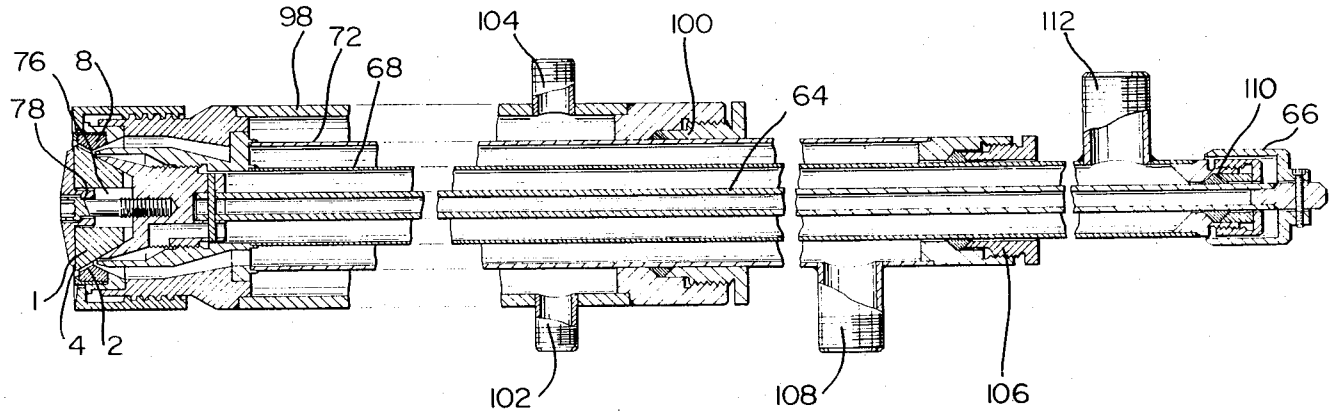

This invention relates to an atomizing nozzle assembly.

It has already been proposed in U.S. Pat. No. 4,592,506, dated June 3, 1986, "Wear Resistant Nozzle Assembly", C. E. Capes, A. J. Bennett, K. A. Jonasson and W. L. Thayer, to provide a wear resistant nozzle assembly having an outwardly diverging frustum of a cone shaped deflector core of wear resistant ceramic and a nozzle rim of wear resistant ceramic and having an outwardly flared inner surface encircling the core to form a flared, atomizing nozzle orifice therewith. The core is mounted in a flared socket of a deflector core holder and inner and outer sleeves feed, say, atomizing air to the deflector core surface and, say, a coal liquid mixture fuel inwardly around the nozzle rim so that the fuel is held by the air as a film against the nozzle rim inner surface and then atomized as it emerges from the nozzle rim.

It has already been proposed by the applicants in the Proceedings of the Fifth International Workshop on Coal-Liquids Fuels Technology, pages 364 to 378, held at Halifax, Nova Scotia, Canada, October, 1985, to provide a burner assembly for coal liquid mixtures wherein the geometry of an abruptly terminating mixing zone is adjusted by means of a screw threaded engagement at the upstream end of coaxial tubes which deliver the atomizing air and fuel to the nozzle at the downstream ends of these tubes.

While the burner assemblies disclosed in U.S. Pat. No. 4,592,506 and at the above mentioned workshop are useful, there is a need for an atomizing nozzle assembly wherein an adjusting mechanism mounts the deflector core to the nozzle rim in close proximity to the mixing zone, and means are provided for accommodating differential thermal expansions between members attached to, and for delivering fluids to the mixing zone between, the deflector core and nozzle rim, and extending rearwardly from the adjustment mechanism, in order that the effects of these differential expansions on the nozzle setting are negligible giving substantially constant atomization, and damage to the ceramic nozzle parts due to these differential thermal expansions is avoided.

According to the present invention there is provided an atomizing nozzle assembly comprising:

(a) a frustum of a cone shaped, deflector core of a wear resistant ceramic material, said deflector having an outwardly diverging surface leading to a chamfered extremity, in a downstream direction for liquid-to-be-atomized, an outer portion of the diverging surface of the deflector core forming an outwardly deflecting surface for, in operation, an atomizing fluid jet to flow in an unobstructed manner along the whole length thereof, (b) a nozzle rim of a wear resistant ceramic material, the rim having a wedge-shaped inward protrusion with a downstream side of the wedge shape protrusion having an outwardly flared, inner surface which is substantially parallel to, and co-extensive with, a downstream portion of the outwardly diverging surface of the deflector core to form therewith a mixing zone leading to an atomizing nozzle orifice outlet so that, in operation, liquid-to-be-atomized will be held against the surfaces bounding the mixing zone, until it is substantially completely mixed, and atomized as it emerges from the orifice outlet, (c) a deflector core holder having a screw threaded upstream end and a flared socket portion at a downstream end, the flared socket portion having an outer, cylindrically shaped extremity, the flared socket having an upstream portion of the deflector core closely fitting and aligned therein, the flared socket portion, in operation, providing a smooth outer surface for guiding atomizing fluid towards and along the outwardly deflecting surface of the outer portion of the deflector core protruding from the flared socket portion, (d) securing means securing the deflector core in the flared socket portion, (e) an inner, cylindrical sleeve having a screw threaded, inner, upstream end portion in threaded engagement in an adjustable manner, with the screw threaded, upstream end portion of the deflector core holder and having a downstream end portion with an enlarged bore and terminating at a downstream end having inner and outer chamfers, the downstream end portion being around the flared socket portion to form a fluid passage around the cylindrically shaped extremity of the deflector core holder having a substantially constant cross-sectional area for, in operation, passing a substantially constant stream of atomizing fluid therealong to an atomizing fluid orifice formed between the inner chamfer and the outer deflecting surface of the flared socket so that, in operation, a jet of the atomizing fluid will issue from the atomizing fluid orifice and be directed along the outer portion of the outwardly deflecting surface of the deflector core, (f) an upstream collar forming a mounting means on the front end of the inner, cylindrical sleeve, (g) an outer, cylindrical sleeve sealed and secured against relative movement by the upstream collar on the front end of the inner sleeve and having a stepped, annular recessed portion at the downstream end with the nozzle rim mounted therein and protruding radially inwardly therefrom, a portion of the outer sleeve having a relatively larger bore diameter than the outside diameter of the inner sleeve and forming therearound an unobstructed, liquid passage having a cross-sectional area for, in operation, conveying liquid-to-be-atomized at a predetermined mass flow rate towards the upstream side of, and inwardly around, the wedge-shaped protrusion of the nozzle rim, (h) means securing the nozzle rim in the stepped, annular recessed portion, (i) an adjustment means connected to the deflector core holder for adjusting the screw threaded engagement between the deflector core holder and the inner cylindrical sleeve to thereby adjust the width (W) of the mixing zone, (j) means for delivering atomizing fluid to the fluid passage, (k) means for delivering liquid-to-be-atomized to the liquid-to-be-atomized passage, and a differential thermal expansion accommodating gland slidably mounting an intermediate portion of the inner, cylindrical sleeve in a rear end portion of the outer, cylindrical sleeve.

In some embodiments of the present invention the adjustment means is capable of adjusting the width of the mixing zone to an L to W range ratio which is within the range of about 5:1 to about 10:1, preferably 7:1 to 8:1, where L is the length of the mixing zone in the direction of flow therethrough and W is the width of the mixing zone.

In other embodiments of the present invention the face forming the chamfered extremity of the deflector core, and a downstream side face of the nozzle rim, are symmetrically inclined, at any circumferential position, with respect to a centerline extending along the mixing zone at that circumferential position, at an included angle ($\alpha°$) in the ratio with respect to the angle ($\theta°$), at which the atomizing fluid is directed towards the outwardly diverging surface of the deflector core of about 130°:50° to about 100°:80°.

The adjustment means may comprise a shaft for rotating the deflector core and extending rearwardly therefrom along the inner cylindrical sleeve, a gland slidably mounting a rear end portion of the shaft, which extends therethrough, in the inner cylindrical sleeve, means for rotating the rear end of the shaft.

A heat exchange casing may be provided around the outer cylindrical sleeve and mounted therearound at a front end by the said mounting means, and a differential thermal expansion accommodating gland slidably mounting a rear end portion of the heat exchange casing on the outer cylindrical sleeve.

Figure 2:
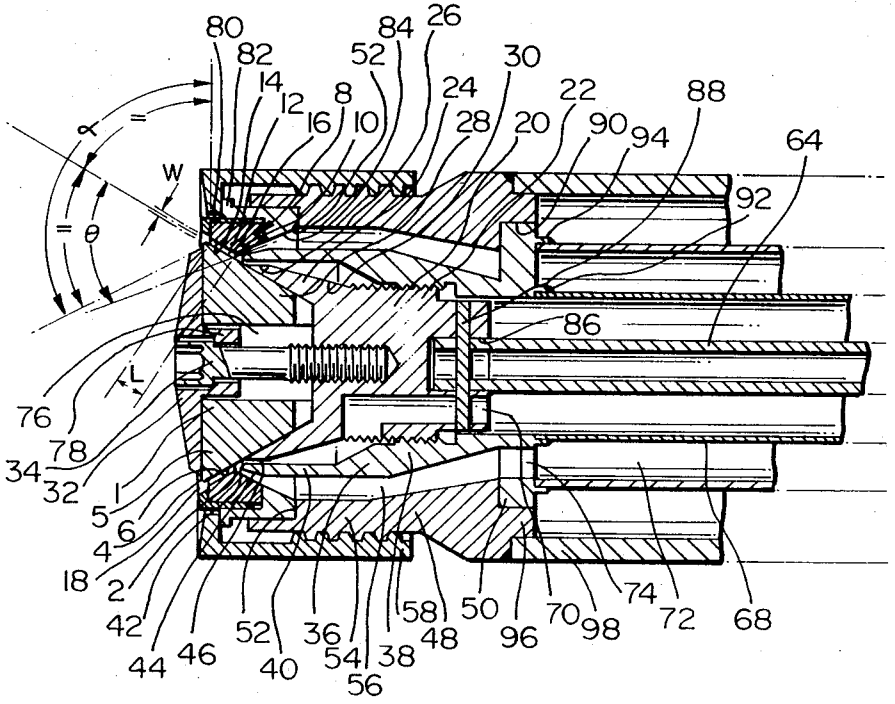

In the accompanying drawings which illustrate, by way of example, an embodiment of the present invention, FIG. 1 is a sectional side view of an atomizing nozzle, and FIG. 2 is an enlarged sectional side view of the nozzle components of the nozzle assembly shown in FIG. 1.

Referring now to FIGS. 1 and 2 there is shown an atomizing nozzle assembly comprising:

(a) a frustum of a cone shaped, deflector core 1 of a wear resistant ceramic material, said deflector having an outwardly diverging surface 2 leading to a chamfered extremity 4, in a downstream direction for liquid-to-be-atomized, an outer portion 5 of the diverging surface of the deflector core, an outwardly deflecting surface 6 for, in operation, an atomizing fluid jet to flow in an unobstructed manner along the whole length thereof, (b) a nozzle rim 8 of a wear resistant ceramic material, the rim having a wedge-shaped inward protrusion 10 with a downstream side 12 of the wedge shape protrusion 10 having an outwardly flared, inner surface 14 which is substantially parallel to, and co-extensive with, a downstream portion of the outwardly diverging surface 2 of the deflector core 1 to form therewith a mixing zone 16 leading to an atomizing nozzle orifice outlet 18 so that, in operation, liquid-to-be-atomized will be held against the surfaces 2 and 14 bounding the mixing zone 16, until it is substantially completely mixed, and then atomized as it emerges from the orifice outlet 18, (c) a deflector core holder 20 having a screw threaded upstream end portion 22 and a flared socket portion 24 at a downstream end, the flared socket portion 24 having an outer, cylindrically shaped extremity 26, the flared socket portion 24 having an upstream portion 28 of the deflector core 1 closely fitting and aligned therein, the flared socket portion 24, in operation, providing a smooth outer surface 24 for guiding atomizing fluid towards and along the outwardly deflecting surface 6 of the outer portion 5 of the deflector core 1 protruding from the flared socket portion 24, (d) securing means in the form of a cap 32 and bolt 34 securing the deflector core 1 in the flared socket portion 24, (e) an inner, cylindrical sleeve 36 having a screw threaded, inner, upstream end portion 38 in threaded engagement in an adjustable manner, with the screw threaded, upstream end portion 22 of the deflector core holder 20 and having a downstream end portion 40 with an enlarged bore and terminating at a downstream end having inner and outer chamfers 42 and 44 respectively, the downstream end portion 46 being around the flared socket portion 24 to form a fluid passage 46 around the cylindrically shaped extremity 26 of the deflector core holder 20 for, in operation, passing a substantially constant stream of atomizing air therealong to an atomizing fluid orifice formed between the inner chamfer 42 and the outer deflecting surface 6 of the flared socket so that, in operation, a jet of the atomizing fluid will issue from the atomizing fluid orifice and be directed along the outer portion 5 of the outwardly deflecting surface of the deflector core 1, (f) an upstream collar 50 forming a mounting means on the front end of the inner, cylindrical sleeve 36, (g) an outer, cylindrical sleeve 48 sealed on, and secured against relative movement by the upstream collar 50 on the front end of the inner sleeve 36 and having a stepped, annular recessed portion 52 at the downstream end with the nozzle rim 8 mounted therein and protruding radially inwardly therefrom, a portion 54 of the outer sleeve 48 having a relatively larger bore diameter than the outside diameter of the inner sleeve 36 and forming therearound an unobstructed, liquid passage 56 for, in operation, conveying liquid-to-be-atomized towards the upstream side of, and inwardly around, the wedge-shaped protrusion 10 of the nozzle rim 8, (h) means, in the form of a threaded collar 58, securing the nozzle rim 8 in the stepped, annular recessed portion 52, (i) an adjustment means, in the form of shaft 64 and barrel 66 (FIG. 1), connected to the deflector core holder 20 for adjusting the screw threaded engagement between the deflector core holder 20 and the inner cylindrical sleeve 36 to thereby adjust the width (W) of the mixing zone, (j) means, in the form of a tube 68, forming in the embodiment an intermediate portion of the cylindrical sleeve 36, and ports such as port 70, for delivering atomizing fluid to the fluid passage 46, (k) means, in the form of tube 72, forming in this embodiment a rear end portion of the cylindrical sleeve 48, and ports such as port 74 in the collar 50, for delivering liquid-to-be-atomized to the liquid-to-be-atomized passage, and (l) a differential thermal expansion accommodating gland 106 slidably mounting the intermediate portion 68 of the inner, cylindrical sleeve 36 in the rear end portion 72 of the outer, cylindrical sleeve 48.

The deflector core 1 has a bore 76 in which a spigot 78 of the cap 32 is located, and the head of the bolt 34 is countersunk in the cap 32 to be flush therewith.

The nozzle rim 8 is located in a retaining ring 80 which is welded in a locating sleeve 82. The locating sleeve 82, whose inner surface 84 forms a part of the boundary of the liquid passage 56, is secured in the stepped, annular recessed portion 52 by the threaded collar 58.

The deflector core holder 20 has a recess 86 in which the shaft 64 is secured by means of a pin 88.

The collar 50 of the inner sleeve 36 is located in a recess 90 in the outer sleeve 48 and has annular rings 92 and 94 locating the tubes 68 and 72 respectively which are welded in position.

The outer sleeve 48 has a step 96 locating an outer, cylindrical casing 98 which is welded to the outer sleeve 48.

As shown in FIG. 1, the casing 98 supports and seals the upstream rear end portion of the tube 72 in a relatively slidable manner by means of a packing gland 100, and forms a heat exchange casing with a heat exchange fluid inlet 102 and outlet 104. The heat exchange fluid may be coolant water, for cooling the nozzle assembly, or steam for heating the liquid-to-be-atomized (e.g. a coal slurry fuel) for lowering its viscosity, and the packing gland 100 accommodates differential thermal expansion between the tube 72 and the casing 98.

As previously stated, the tube 72 is sealed around a rear end portion of the tube 68 in a relatively slidable manner by the differential thermal expansion accommodating gland 106, which is a packing gland, and has an inlet 108 for liquid-to-be-atomized.

The tube 68 is sealed in a slidable manner around a rear end portion of the shaft 64 by a gland 110 and has an atomizing fluid inlet 112.

The apparatus shown in FIGS. 1 and 2 was primarily designed for use in tests as a liquid mixture fuel atomizer and will be described, in operation, atomizing a deashed, pulverized coal liquid mixture fuel using the atomizing air of a conventional oil burner assembly (not shown) where secondary, combustion air is swirled around the atomized fuel.

In operation, with the apparatus arranged as shown in FIGS. 1 and 2, atomizing air is fed along the bore of the tube 64, through the ports, such as port 70, to the fluid passage 46 from which it is directed as a jet in an unobstructed manner through the mixing zone 16 along the surface 6 of the deflector core 1. At the same time the pulverized coal liquid mixture fuel is fed along the bore of the tube 72 through the ports, such as port 74, to the liquid passage 56 from which it is directed along the mixing zone 16.

The jet of air from the fluid passage 46, flowing along the surface 6 of the deflector core 1 causes the pulverized coal liquid mixture to initially be held as a hollow cone-shaped film against the flared inner surface 14 of the nozzle rim 8 so that there is negligible contact between the fuel and the deflector core. As the cone-shaped film of fuel travels along the mixing zone 16 it is thoroughly mixed with the air and emerges from the mixing zone 16 as an atomized jet.

The width W (FIG. 2) of the mixing zone 16 can be adjusted while the nozzle assembly is in use by means of the barrel 66 and the screw threaded engagement between the deflector core holder 20 and the inner cylindrical sleeve 36.

It should be noted that there is negligible change in the width W of the mixing zone 16 due to differential thermal expansion because of the close proximity of the screw threaded engagement between the deflector core holder 20 and the inner cylindrical sleeve 36 to the mixing zone 16, and the fact that differential thermal expansions between the shaft 64, tubes 68 and 72 and the casing 98 are accommodated by means of the glands 66, 106 and 100 respectively.

Tests using the nozzle shown in FIGS. 1 and 2, and coal-water fuel of 70:30 by weight ratio and No. 6 bunker oil fuel have been made to show the efficacy of nozzles according to the present invention.

These tests were run in an existing oil fired utility.

The nozzle rim 8 had a minimum inside diameter of 2.25 inches (57.15 mm) and a maximum inside diameter in the downstream direction of 2.539 inches (64.49 mm). The deflector core 1 had a maximum diameter of 2.460 inches (62.48 mm) at the outlet of the mixing zone 16. The mixing zone 16 had a nominal width (W) of 0.035 inches and the length/width (L/W, FIG. 2) ratio was varied between 7 and 12.

These tests demonstrated the ability of atomizing nozzles according to the present invention to atomize coal slurry fuels which have been difficult to atomize by known atomizing nozzles. The good atomization of these fuels by atomizing nozzles according to the present invention is demonstrated by the clean, recirculated flames that are obtained with little fall out due to incomplete combustion.

From the tests it was found that with a fuel comprising 70:30 by weight ratio coal:water and an L:W ratio of 7:1, a carbon conversion of >99.5% was found to occur by analyzing the flue gas ash content whereas the carbon conversion under similar conditions for known atomizing nozzles was 96.2%.

We claim:

1. An atomizing nozzle assembly comprising:

(a) a frustum of a cone shaped, deflector core of a wear resistant ceramic material, said deflector having an outwardly diverging surface leading to a chamfered extremity, in a downstream direction for liquid-to-be-atomized, an outer portion of the diverging surface of the deflector core forming an outwardly deflecting surface for, in operation, an atomizing fluid jet to flow in an unobstructed manner along the whole length thereof, (b) a nozzle rim of a wear resistant ceramic material, the rim having a wedge-shaped inward protrusion with a downstream side of the wedge-shaped protrusion having an outwardly flared, inner surface which is substantially parallel to, and co-extensive with, a downstream portion of the outwardly diverging surface of the deflector core to form therewith a mixing zone leading to an atomizing nozzle orifice outlet so that, in operation, liquid-to-be-atomized will be held against the surfaces bounding the mixing zone, until it is substantially completely mixed, and atomized as it emerges from the orifice outlet, (c) a deflector core holder having a screw threaded upstream end and a flared socket portion at a downstream end, the flared socket portion having an outer, cylindrically shaped extremity, the flared socket having an upstream portion of the deflector core closely fitting and aligned therein, the flared socket portion, in operation, providing a smooth outer surface for guiding atomizing fluid towards and along the outwardly deflecting surface of the outer portion of the deflector core protruding from the flared socket portion, (d) securing means securing the deflector core in the flared socket portion, (e) an inner, cylindrical sleeve having a screw threaded, inner, upstream end portion, which is in close proximity to the mixing zone and is in threaded engagement in an adjustable manner with the screw threaded, upstream end portion of the deflector core holder, the inner cylindrical sleeve having a downstream end portion with an enlarged bore and terminating at a downstream end having inner and outer chamfers, the downstream end portion being around the flared socket portion to form a fluid passage around the cylindrically shaped extremity of the deflector core holder for, in operation, passing a substantially constant stream of atomizing fluid therealong to an atomizing fluid orifice formed between the inner chamfer and the outer deflecting surface of the flared socket so that, in operation, a jet of the atomizing fluid will issue from the atomizing fluid orifice and be directed along the outer portion of the outwardly deflecting surface of the deflector core, (f) an upstream collar forming a mounting means on the front end of the inner, cylindrical sleeve, (g) an outer, cylindrical sleeve sealed on, and secured against relative movement by the upstream collar on the front end of the inner sleeve and having a stepped, annular recessed portion at the downstream end with the nozzle rim mounted therein and protruding radially inwardly therefrom, a portion of the outer sleeve having a relatively larger bore diameter than the outside diameter of the inner sleeve and forming therearound an unobstructed, liquid passage for, in operation, conveying liquid-to-be-atomized towards the upstream side of, and inwardly around, the wedge-shaped protrusion of the nozzle rim, (h) means securing the nozzle rim in the stepped, annular recessed portion, (i) an adjustment means connected to the deflector core holder for adjusting the screw threaded engagement between the deflector core holder and the inner cylindrical sleeve to thereby adjust the width (W) of the mixing zone, (j) means for delivering atomizing fluid to the fluid passage, (k) means for delivering liquid-to-be-atomized to the liquid-to-be-atomized passage, and (l) a differential thermal expansion accommodating gland slidably mounting an intermediate portion of the inner, cylindrical sleeve in a rear end portion of the outer cylindrical sleeve.

2. A nozzle assembly according to claim 1, further comprising a heat exchange casing around the outer cylindrical sleeve and mounted therearound at a front end at the said mounting means, and a differential thermal expansion accommodating gland slidably mounting a rear end portion of the heating exchange casing on a rear end portion of the outer cylindrical sleeve.

* * * * *